United States Patent [19]

Godlewski

[11] 3,977,672

[45] Aug. 31, 1976

[54] AUXILIARY MECHANISM FOR LIFTING STOCK TO PRESS INTAKE

[76] Inventor: Edward S. Godlewski, 129 S. Spruce St., Wooddale, Ill. 60119

[22] Filed: Apr. 20, 1975

[21] Appl. No.: 572,882

[52] U.S. Cl. ..... 271/264; 271/30 R; 271/118; 271/147; 271/162

[51] Int. Cl.[2] ..... B65H 5/00; B65H 5/10

[58] Field of Search ..... 271/3.1, 30 R, 94, 107, 271/118, 267, 265, 268, 264, 276, 194, 84, 85, 245, 247, 8 R, 162, 145, 147, 10

[56] References Cited

UNITED STATES PATENTS

| | | | |
|---|---|---|---|
| 1,695,648 | 12/1928 | Giesecke et al. | 271/276 |
| 2,031,078 | 2/1936 | Spiess | 271/94 |
| 2,741,886 | 4/1956 | Garapolo | 271/162 X |
| 3,322,602 | 5/1967 | Schneider | 271/162 X |

*Primary Examiner*—Evon C. Blunk
*Assistant Examiner*—Bruce H. Stoner, Jr.
*Attorney, Agent, or Firm*—John J. Kowalik

[57] ABSTRACT

An auxiliary feed mechanism adapted to be positioned at the intake of a printing press to lift stock such as paper or envelopes, particularly those which have become warped from storage, to a vacuum feed of the printing press. The feed mechanism includes an adjustably positionable flipper pivoted by a solenoid to lift a stock item from supporting rails to the press vacuum feed.

10 Claims, 6 Drawing Figures

AUXILIARY MECHANISM FOR LIFTING STOCK TO PRESS INTAKE

DISCUSSION OF THE PRIOR ART

In feed mechanisms delivering to presses having a vacuum infeed, no adequate mechanism has been heretofore available which provided an effective transition between the delivery end of a stack feeder and the vacuum infeed of the printer. The problem which exists with such apparatus is amplified when attempts are made to feed curled stock. It is incumbent in present equipment to position the suction cups of the vacuum feed in close proximity to the stock being delivered thereto within the ambit of the suction head for the stock to be drawn up against the vacuum cups. The necessary close spacial relationship preempts adjustment of the suction cups a distance sufficient to clear the curled stock which must be delivered underneath the suction cups by the feed conveyor. The curl of the stock, such as paper, frustrates the suction action not only because the curl reduces the flexibility of paper so that it does not readily deflect toward the cups but also because entry under the cups is prevented by the cups when in pick-up position, since the cups in such position obstruct entry of the paper therebeneath because there is not enough space.

SUMMARY OF THE INVENTION

This invention is directed to a novel mechanism for lifting the stock delivered beneath the suction cups whereby permitting a wide latitude of spacing between the suction and the delivery conveyor to thus accommodate variations in the stock profiles.

A specific object of the invention is to provide a novel mechanism which provides a positive delivery of the stock to the feed means of the press.

Another object is to provide a novel mechanism which is easy to mount to existing equipment and which incorporates means for not only positioning individual components of the mechanism but also the mechanism in toto.

Another object is to provide a novel stock delivery system in which an auxiliary feed mechanism is triggered to operate only when there is stock available for delivery and also the suction cups are in pick-up position.

A further object is to provide a novel auxiliary feed mechanism which comprises a lift tab pivotal about a horizontal axis and fitted between the rails of a delivery conveyor upon which the stock is guided to the press feed means, the tab having a distal end portion which is angled downwardly and providing a ridge with the body portion of the tab, tab being adjustable to position the ridge in a location to bend the stock, such as sheets of paper behind the suction cups of the infeed mechanism of the press so that upon the stock being pressed to the cups it presents an optimum surface condition whereby the cups obtain a good suction purchase on the stock, thereby preventing misses.

These and other objects and advantages inherent in and encompassed by the invention will become readily apparent from the specification and the drawings, wherein.

DESCRIPTION OF THE INVENTION

Figure 1:
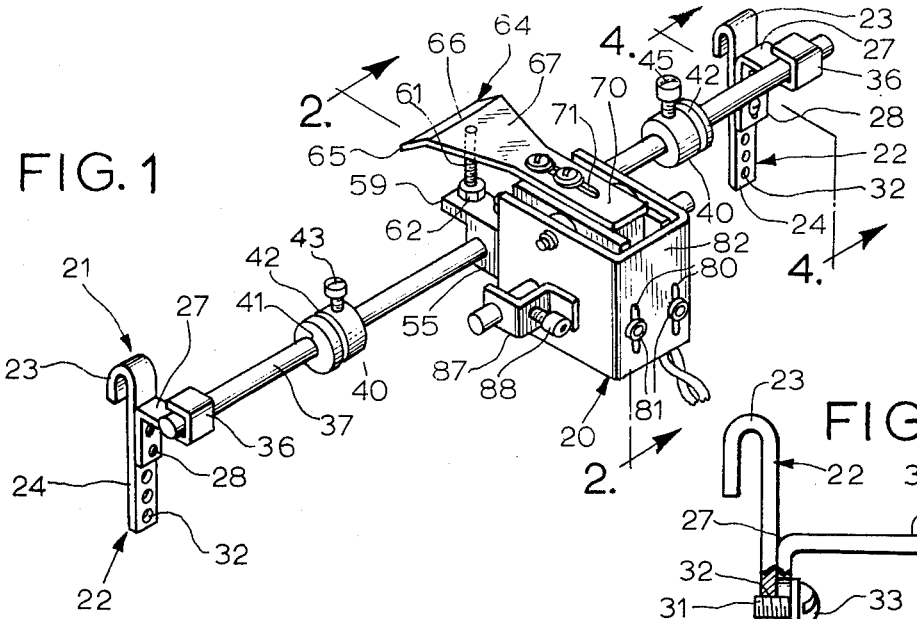
FIG. 1 is a perspective view of the novel auxiliary feed mechanism.

The printing machine or press generally designated 1 is of conventional design and comprises a pair of vertical side plates 2 and 3 and a transverse vertical mounting plate 4 interconnecting the side plates. A vacuum cup pick-up mechanism 5 is swingably mounted on a shaft 6 which oscillates by means of associated mechanism well known about a horizontal axis on bearings 7 mounted on the side plates. The shaft 6 is connected to radially extending arms 8 which at their distal ends are connected to a suction tube 9 for pendulating the tube and a plurality of integral suction-cup-supporting tubes 10,10, which depend from tube 9, between a lowered pick-up position shown in solid lines in FIG. 5 and a delivery position shown in FIG. 5 in dotted lines to a pair of infeed rolls 12,13 of the press.

Figure 5:
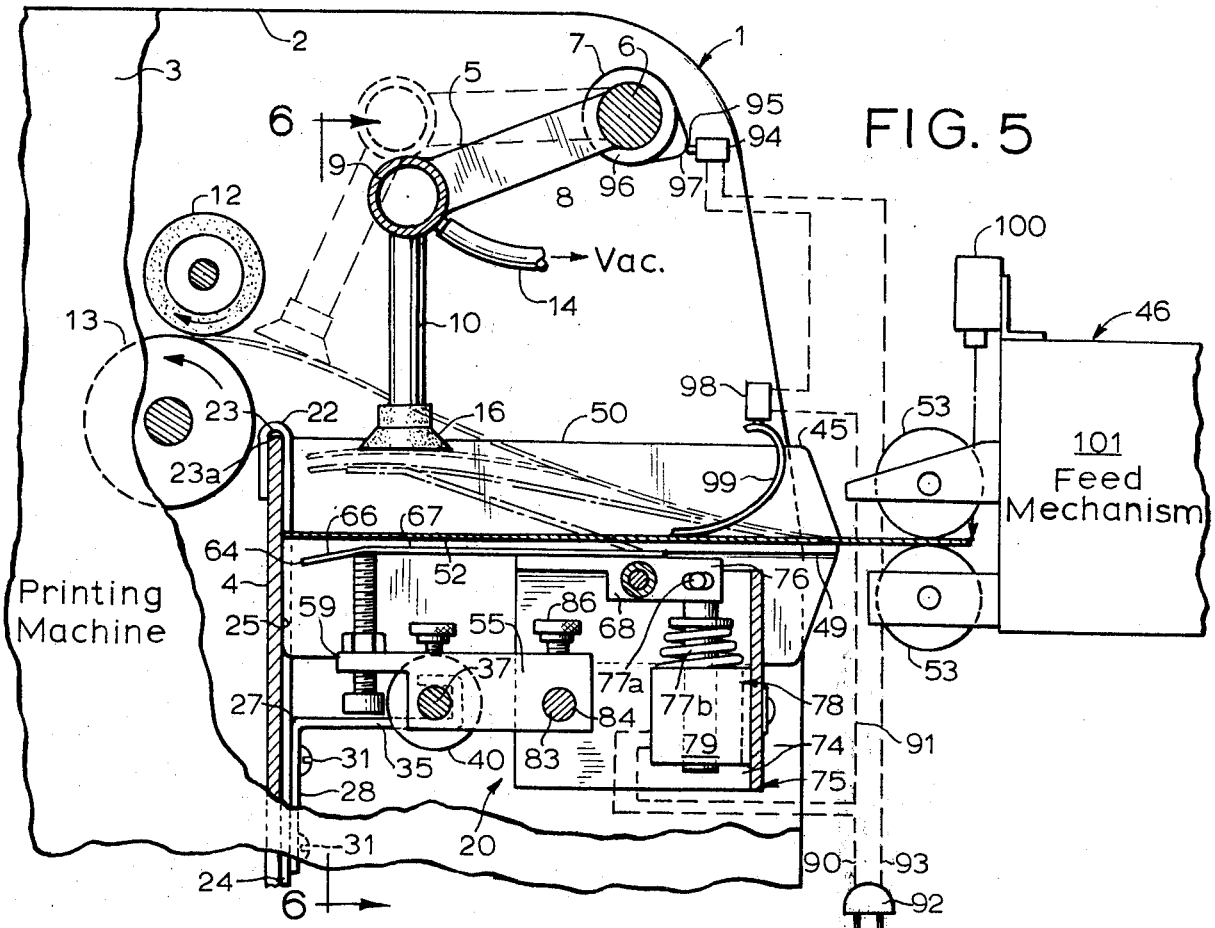
FIG. 5 is a longitudinal sectional view of a portion of a printing press shown in association with my novel feed mechanism.
Figure 6:
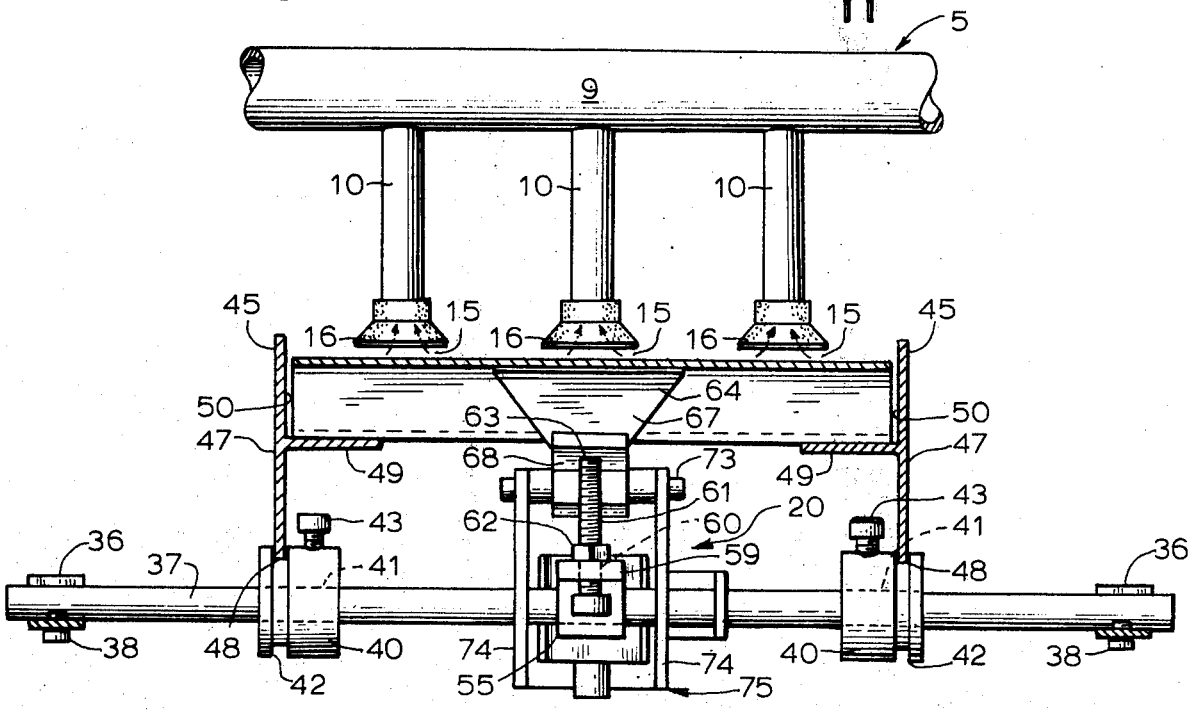
FIG. 6 is a cross-sectional view taken substantially on line 6—6 of FIG. 5.

A vacuum line 14 is fragmentarily shown in FIG. 5 through which air is withdrawn by suitable well known means to provide a vacuum head shown at 15 in FIG. 6. The suction heads or cups 16 at the lower ends of tubes 10,10 may be of elastomer material such as rubber or plastic, but preferably are of metal which cooperate with auxiliary feed mechanism generally designated 20.

The auxiliary feed mechanism comprises a bracket 21 assembly which includes a laterally spaced pair of hangers 22,22 each of which has a hook portion 23 at its upper end which is adapted to be hooked over the upper edge 23a of the mounting plate 4 of the press as best shown in FIG. 5. Each hanger 22 has a flat strap 24 depending from the hook portion and adapted to lie against the flat external vertical side 25 of the plate 4.

Figure 4:
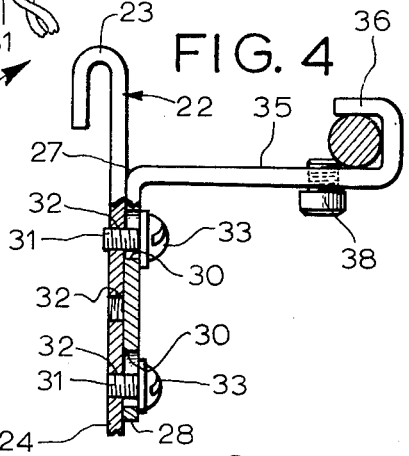
FIG. 4 is an enlarged cross-sectional view taken substantially on line 4—4 of FIG. 1.
Figure 2:
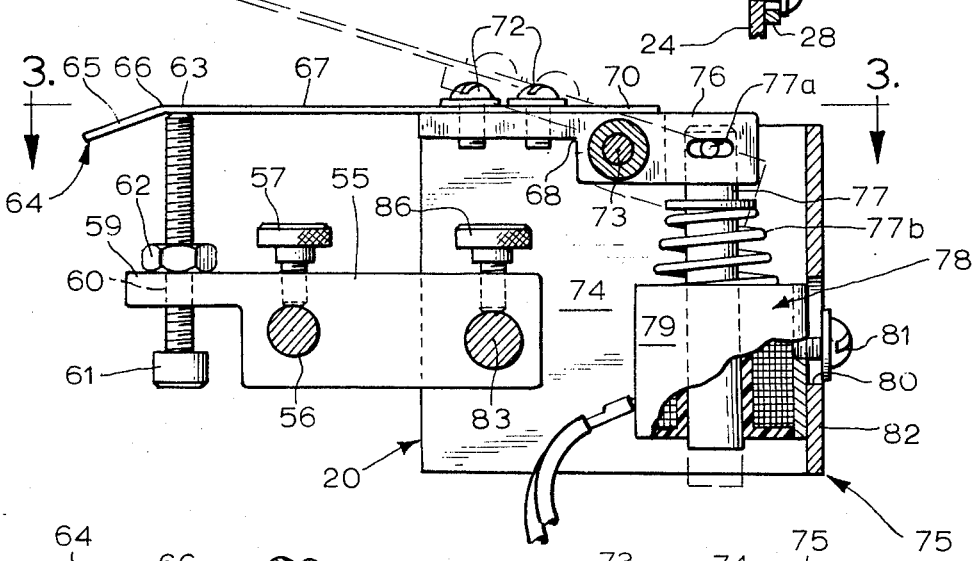
FIG. 2 is an enlarged transverse vertical sectional view taken substantially on line 2—2 of FIG. 1.
Figure 3:
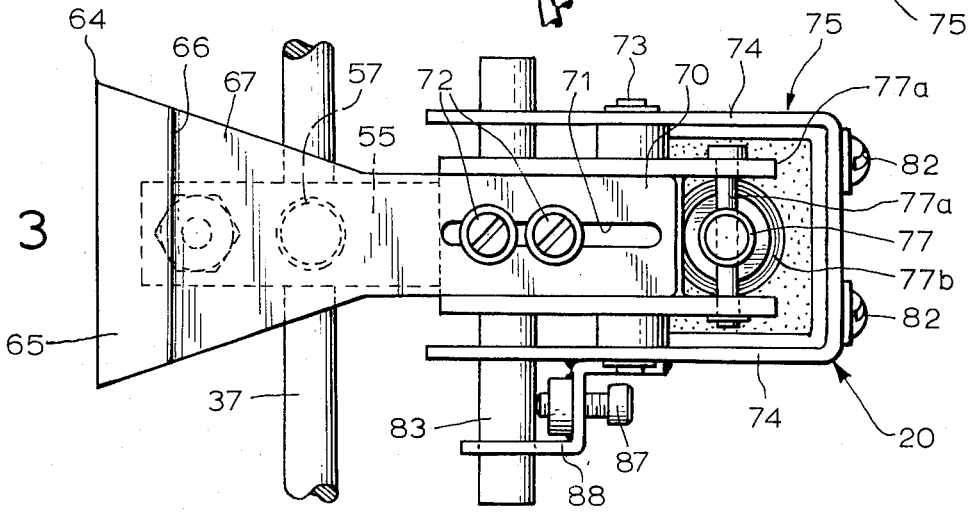
FIG. 3 is a top plan view taken substantially on line 3—3 of FIG. 2.

An L-shaped bracket 27 is mounted on each hanger, each bracket 27 comprising a vertical leg 28 with vertically elongated slots 30,30 through which bolts 31,31 are secured in selected threaded apertures 32 in the associated hanger strap 24 as best seen in FIG. 4. This permits vertical adjustment of brackets 27 with reference to the hangers 22. After adjustment the screws are tightened abutting the heads 33 (FIG. 4) of the screws against the leg 28. Each bracket has a horizontal leg 35 (FIGS. 4 and 5) at the upper end of leg 28 and the distal end of each leg 35 is formed with a jaw 36, within which there is positioned a rod 37. The rod 37 is secured to the jaw by a tangent bolt 38 which is threaded through the leg 35 at the open end of the jaw 36 and engages the cylindrical periphery of the rod and forces the rod tightly into the jaw. The entire auxiliary feed mechanism is thus pivotally supported on a horizontal axis and may be tilted vertically about rod 37 for adjustment and set.

The rod 37 slidably supports a pair of rail mounts 40,40 each of which is a cylindrical element having a bore 41 through which the rod 37 passes and having a peripheral annular groove 42. A set screw 43 is threaded in the element for tightening against the rod after it is set in its laterally adjusted position compatible with the required spacing of a pair of side rails 45,45 of the stock conveyor feed mechanism generally designated 46.

Each side rail 45 comprises a vertical web 47 which at its lower edge 48 fits into groove 42 of the related mount 40. Each rail 45 also comprises a horizontal stock-supporting flange 49 intermediate its upper and lower edges. The vertical opposing sides 50,50 of the rails confine and guide the stock 52 which is discharged from a pair of discharge rollers 53,53 of the feed mechanism which may be of the type shown in U.S. Pat. No. 3,612,513.

In the space between the side rails and below the flanges 49 the auxiliary flipper or conveying mechanism 20 is disposed and comprises a mounting block 55 which has a transverse bore 56 at its forward end through which the rod 37 of the mounting bracket extends. A set screw 57 is threaded in the block and extends into bore 56 and is adapted to be tightened against the rod 37. Thus the entire mechanism 20 can be tilted about shaft 37. The forward end of the mounting block has a thin projection 59 which has a vertical threaded aperture 60 through which an abutment screw 61 is adapted to be threaded and which can be locked by a lock nut 62 against the top of the block. The upper end of the bolt provides a stop at 63 against the underside of a tab or flipper 64 which has a downwardly angled distal end portion 65 which forms a ridge 66 at its juncture with the body portion 67. The flat body portion 67 overlays a pivot bar 68.

The flap 64 has a narrow proximal end portion 70 with an elongated slot 71 through which a pair of screws 72,72 are threaded into one end of pivot bar 68. The flap 64 is longitudinally adjustable within the limits of slot 71.

The bushed pivot bar 68 is pivoted on a horizontal shaft 73 which extends through apertures in a pair of vertical side walls 74,74 of a housing 75 and at its other split end 76 has a pin and slot connection 77a with the upper end of a pull rod 77 of a solenoid 78. The rod 77 extends through a compression return spring 77b and a solenoid coil 79 which is vertically adjustably secured through vertically elongated slots 80 and bolts 81 to the upright back wall 82 of the housing 75.

The side walls 74,74 of the housing 75 also support a horizontal shaft 83 which passes through a horizontal bore 84 in the rear end portion of the mounting block 55. A set screw 86 extends into the bore 84 and abuts shaft 83. The housing 75 and flap and solenoid can be tilted about rod 83 to affect the disposition of the flap. The rod 83 is also set by a screw 87 mounted on bracket 88 welded to side wall 74 of the housing 75.

The coil 79 has two lead in wires 90 and 91. Wire or lead 90 is connected to a plug 92 for connection to a power source. Lead 93 from plug 92 is connected to one contact of a microswitch 94 which may be mounted on panel 2 of the press. The switch 94 has a switching element 95 riding on the profile of cam 96 which is connected to the shaft 6. The crest 97 of the cam positions the element 95 to close the switch at the time when the suckers are in pick-up position (See FIG. 5). Switch 94 is connected to one contact of another microswitch 98 which may be mounted on panel 2 and the other contact of switch 98 is connected to the lead 91 of the solenoid coil. Switch 98 is controlled by an arm or whisker 99 which is lifted to close the switch 98 by the stock sliding thereunder as seen in FIG. 5. If no stock 52 is present under arm 99, the switch 98 remains open and the flipper will not be actuated.

The feed mechanism 46 is also controlled by a switch 100 which is mounted on the frame 101. Switch 100 senses the exit of the stock 52, such as a card, envelope, etc., from the feed mechanism and closes the circuit to permit actuation of other components of the feed mechanism. It will be noted that surface 25 on plate 4 serves as a stop limiting forward movement of the stock.

It will be apparent that the auxiliary feeder can be adjusted in various locations to and fro with respect to the suckers and that the angular arrangement of the flipper or tab permits the paper to drape over the forward end of the flap and be presented flat against the suction heads. Any crinkled or warped stock can feed under the suckers since the spacing between the delivery rails of the feed mechanisms can be increased. The stroke of the flipper 64 can be adjusted and after the flipper 64 is raised it will rapidly return by expansion of the spring **77*b* although the flipper 64** will drop by gravity at the terminal end of its drop stroke.

A novel and effective transition conveying device has been provided which is adaptable as an apparatus presently available without extensive modification, and which is easy to mount and remove.

A preferred embodiment of the invention has been disclosed. However, it will be understood that variations of the invention will now become readily apparent which come within the scope of the appended claims.

I claim:

1. A mechanism for delivering stock items to a vacuum feed of the type having suction heads movable between pick-up and discharge positions for picking up an individual stock item from a support and discharging it to associated apparatus comprising:

lifting means;

means movably mounting said lifting means to move in a predetermined path for lifting the stock item from the support toward said suction heads;

means for actuating said lifting means attendant to said suction heads being disposed in pick-up position;

said lifting means comprising a flipper and means pivoting said flipper about a horizontal axis;

and said flipper comprising a plate-like element having a body portion, and a distal end portion inclined downwardly away from said body portion and forming a ridge therewith for engaging the stock item and draping it over said distal end portion, said distal end portion being located to press the stock item in alignment with said suction heads.

2. A mechanism for delivering stock items to a vacuum feed of the type having suction heads movable between pick-up and discharge positions for picking up stock from a support and discharging it to associated apparatus comprising:

lifting means disposed beneath the support;

means movably mounting said lifting means to move in a predetermined path for lifting the stock from the support toward said suction heads;

and means for actuating said mounting means for operating said lifting means attendant to said suction heads being disposed in pick-up position;

and said support comprising a pair of rails supporting the stock therebetween and said lifting means comprising a flap swingable between said rails from a lowered position beneath said rails to an elevated position lifting the stock and pressing the same against said suction heads, and said mounting means comprising first and second pivotally connected portions, means supporting said first and second portions independently on first and second generally parallel axes extending laterally of the suction heads for independently tilting said portions with respect to said suction heads and thereby positioning said lifting means to properly present said stock to said suction heads.

3. The invention according to claim 2 and said associated apparatus comprising a transverse upright support panel, and means for mounting said mechanism from said panel comprising a bracket assembly having hook means adapted to hook over said panel and having portions adapted to seat against a vertical side of the panel.

4. A mechanism for delivering stock items to a vacuum feed of the type having suction heads movable between pickup and discharge positions for picking up stock from a support and discharging it to associated apparatus comprising:

lifting means disposed beneath the support;

means movably mounting said lifting means to move in a predetermined path for lifting the stock from the support toward said suction heads;

means for actuating said mounting means for operating said lifting means attendant to said suction heads being disposed in pick-up position;

and said support comprising a plurality of rail elements for guiding the stock thereon and said lifting means comprising a flipper, said mounting means comprising a pivot bar providing a generally horizontal axis of pivot for said flipper for movement between a position locating the flipper below the stock to a position elevating the stock off said rail elements and pressing the same against the suction heads, means for hanging said mechanism from said associated apparatus, and a solenoid connected to said pivot bar for actuating the same, and switching means responsive to the positioning of said suction heads for energizing said solenoid.

5. The invention according to claim 4 and additional switching means in series with said mentioned switching means and responsive to occupancy of the stock on said rail elements.

6. A mechanism for delivering stock items to a vacuum feed of the type having suction heads movable between pick-up and discharge positions for picking up stock from a support and discharging it to associated apparatus comprising:

lifting means disposed beneath the support;

means movably mounting said lifting means to move in a predetermined path for lifting the stock from the support toward said suction heads;

means for actuating said mounting means for operating said lifting means attendant to said suction heads being disposed in pick-up position;

and said lifting means and moving means supported for adjustment on an axis tilting the mechanism with respect to said heads, and said lifting means comprising a stock-engaging flap having means for bending the stock and presenting portions of the stock flatwise to the suction heads.

7. A mechanism for delivering stock items to a vacuum feed of the type having suction heads movable between pick-up and discharge positions for picking up an individual stock item from a support and discharging it to associated apparatus comprising:

lifting means disposed to lift the item off the support;

means movably mounting said lifting means to move in a predetermined path for lifting the stock as aforesaid toward said suction heads;

and means for actuating said lifting means attendant to said suction heads being disposed in pick-up position;

said mounting means comprising a plurality of components, and means for positioning said components at selected locations with respect to said suction heads comprising means accommodating tilt adjustment of at least several of the components independently and in toto about axes extending parallel to said suction heads, the positions of all of said components influencing the disposition of said lifting means to optimally locate said lifting means with respect to said suction heads.

8. The invention according to claim 6 and said mounting means comprising adjustable first and second portions, means supporting said first portion on an axis spaced transversely of the suction heads for pivotal movement toward and away with respect to said suction heads, means pivotally connecting said first and second portions on a second axis generally parallel with said first axis, said portions conjuctively pivotal about said first axis and said second portion pivotal independently of the first portion about said second axis, and said flap mounted directly to said second portion, the disposition of said portions about said axes conjuctively positioning said flap to properly present the stock to said suction heads.

9. The invention according to claim 6 and means for adjusting the position of said flap laterally with respect to said suction heads.

10. The invention according to claim 6 and said mechanism comprising a self-contained unit including means for removably mounting the same from said associated apparatus in delivery relation thereto from associated feed mechanism.

* * * * *